US009212489B1

(12) United States Patent
Erickson

(10) Patent No.: US 9,212,489 B1
(45) Date of Patent: Dec. 15, 2015

(54) SKYLIGHT GUARD

(71) Applicant: Safety Rail Company, LLC, Spring Park, MN (US)

(72) Inventor: Craig Erickson, Shorewood, MN (US)

(73) Assignee: Safety Rail Company, LLC, Spring Park, MN (US)

( * ) Notice: Subject to any disclaimer, the term of this patent is extended or adjusted under 35 U.S.C. 154(b) by 0 days.

(21) Appl. No.: 14/682,570

(22) Filed: Apr. 9, 2015

Related U.S. Application Data

(60) Provisional application No. 61/977,444, filed on Apr. 9, 2014.

(51) Int. Cl.
*E04D 13/03* (2006.01)
*E04B 1/92* (2006.01)
*E04B 7/18* (2006.01)

(52) U.S. Cl.
CPC ..... *E04D 13/0335* (2013.01); *E04B 1/92* (2013.01); *E04B 7/18* (2013.01)

(58) Field of Classification Search
CPC ..... E04D 13/0335; E04D 13/03
USPC ..... 52/200, 202
See application file for complete search history.

(56) References Cited

U.S. PATENT DOCUMENTS

| | | | | | |
|---|---|---|---|---|---|
| 1,233,530 | A * | 7/1917 | Whitnell | 52/200 |
| 2,515,451 | A * | 7/1950 | Isacoff | 160/88 |
| 3,762,120 | A * | 10/1973 | Janssen | 52/200 |
| 4,571,897 | A * | 2/1986 | Kerr | 52/13 |
| 4,762,160 | A * | 8/1988 | Bechtold et al. | 160/98 |
| 5,237,788 | A * | 8/1993 | Sandow | 52/200 |
| D354,817 | S * | 1/1995 | Kovacs et al. | D25/48.8 |
| 5,419,090 | A * | 5/1995 | Sandow | 52/200 |
| 5,502,934 | A * | 4/1996 | Coyne et al. | 52/200 |
| 5,669,186 | A * | 9/1997 | Verby et al. | 52/72 |
| 6,009,929 | A * | 1/2000 | Linderman et al. | 160/104 |
| 6,161,348 | A * | 12/2000 | Morris | 52/232 |
| 6,199,330 | B1 * | 3/2001 | Cobb | 52/202 |
| 6,209,271 | B1 * | 4/2001 | Kovacs | 52/200 |
| 7,444,784 | B2 * | 11/2008 | Brown | 52/107 |
| 7,624,547 | B1 * | 12/2009 | Brinton et al. | 52/200 |
| 8,782,973 | B1 * | 7/2014 | Everingham et al. | 52/200 |
| 2002/0139063 | A1 * | 10/2002 | Crane | 52/106 |
| 2009/0107060 | A1 * | 4/2009 | Ellis et al. | 52/200 |
| 2011/0120030 | A1 * | 5/2011 | Swindell et al. | 52/202 |

* cited by examiner

*Primary Examiner* — Joshua J Michener
*Assistant Examiner* — Kyle Walraed-Sullivan
(74) *Attorney, Agent, or Firm* — Christensen Fonder P.A.

(57) ABSTRACT

A guard assembly for a skylight. The assembly includes rails positioned on opposing sides of a skylight frame, connected by tension members that act to pull the rails laterally toward each other, causing the rails to clamp onto the skylight frame. The assembly can be coupled to the skylight without need for penetration fasteners that can cause the skylight to leak. The rails and tension members can be custom sized to proper dimension at a work site. In one embodiment, the guard assembly includes modular reinforcement components that spread out local clamping forces over a large area to mitigate the generation of yield and creep stresses that would otherwise cause the guard assembly to loosen over time. The guard assembly includes a guard structure that extends over the skylight and, in various embodiments, can be readily removed from the guard assembly for servicing of the skylight.

8 Claims, 8 Drawing Sheets

SKYLIGHT GUARD

RELATED APPLICATIONS

This application claims the benefit of U.S. Provisional Patent Application No. 61/977,444, filed Apr. 9, 2014, the disclosure of which is incorporated by reference herein in its entirety.

FIELD OF THE DISCLOSURE

This disclosure relates generally to skylight systems, and more specifically to guard systems for skylights.

BACKGROUND OF THE DISCLOSURE

A common architectural practice in the design of homes and buildings is to utilize skylights to provide or increase the amount of natural light to the interior. Skylights, being disposed generally on the roof tops of structures, are exposed to the damaging effects of falling debris, such as tree shedding (branches, tree nuts, etc.) and ice chunks from higher adjacent structures. Accordingly, skylights can be fitted with guards that protect the skylight from falling debris.

For flat roofs that are common to commercial and industrial buildings, skylights pose a safety hazard. It is common practice for maintenance personnel to access these roofs to perform general maintenance and repairs. The maintenance personnel have been known to accidentally fall onto skylights or, in some instances, intentionally sit on the skylights. As skylights age, they can deteriorate (e.g., turn brittle) and become more prone to breakage upon being flexed. Accordingly, every year there are many fall related fatalities associated with skylights, not only for maintenance personnel falling through the skylight, but also for persons within the building who happen to be below the skylight.

To address these safety hazards, the Occupational Safety and Health Administration (OSHA) considers rooftops of commercial/industrial buildings as a "walking-working surface" and has promulgated regulations regarding the guarding of skylights and other rooftop structures. These regulations are found generally at 29 CFR 1910.23, with skylights addressed more specifically at 29 CFR 1910.23(a)(4) and 29 CFR 1910.23(e)(8). The regulations at 29 CFR 1910.23 are hereby incorporated by reference herein in their entirety, except for express definitions contained therein.

The OSHA regulations have given rise to the commercial availability of skylight guard systems. Problems can arise with these conventional guard systems, particularly in the context of retrofitting the guard to an existing skylight. Some systems require that the guard be secured to the skylight using fasteners that penetrate the frame of the skylight; this can introduce leaks into the skylight. Other systems require no fasteners, but can be subject to forces that cause plastic deformation due to generation of yield stresses and/or creep stresses, causing the guard system to become loosened and insecure over time. Examples of such guards include U.S. Pat. No. 5,237,788 to Sandow and U.S. Pat. No. 6,209,271 to Kovacs, the disclosures of which are hereby incorporated by reference herein in their entirety except for express definitions and patent claims contained therein. Yield and creep stresses can be problematic for certain materials of choice, for example aluminum and aluminum alloys, which are easily extruded, are lightweight, and have excellent corrosion resistance for outdoor applications.

A skylight guard system addresses the shortcomings of conventional skylight guards would be a welcomed addition.

SUMMARY OF THE DISCLOSURE

Various embodiments of the disclosure include a guard assembly for protection of skylights suitable for newly installed skylights as well as for retrofitting to existing skylights, and methods of installation. In one embodiment, the various components of the guard assembly can be sized to proper dimensions at the installation site using standard tools (e.g., a hack saw, a bolt cutter, and/or a wire cutter) to provide a customized fit of the guard assembly to a frame of the skylight. The guard assembly can also include modular reinforcement components that can be field installed to prevent deformation of the guard assembly. In one embodiment, a guard structure that extends over the skylight can be readily removed and reinstalled, for example to service the resident skylight.

Structurally, a skylight assembly is disclosed, comprising a skylight having a substantially rectangular frame and a skylight guard assembly operatively coupled with the frame of the skylight. In one embodiment, the skylight guard assembly includes a pair of rails disposed on opposing sides of the rectangular frame of the skylight, each rail of the pair of rails including a first end and a second end, each of the first end and the second end defining a respective opening. In one embodiment each of the pair of rails are hollow tubular members. A guard structure is operatively coupled with the pair of rails and extends over the skylight. The guard structure can comprise a mesh. The skylight assembly can further comprise a plurality of corner blocks, each disposed in a corresponding one of the respective openings of the first end and the second of the pair of rails. In one embodiment, the skylight assembly includes pair of tension members, each tension member extending substantially between and orthogonal to the pair of rails and being operatively coupled to a respective pair of the plurality of corner blocks. The tension members can be coupled to the corner blocks with threaded fasteners that pass through the corner blocks.

In various embodiments, each of the pair of rails includes a laterally extending flange that extends over the frame of the skylight. Each of the pair of rails can define a channel that extends parallel to the frame of the skylight, the guard structure being disposed in the channel.

Each of the plurality of corner blocks can include an extended portion that extends outward from the corresponding one of the respective openings. The pair of tension members can be coupled to the extended portions of the corner blocks.

In one embodiment, a method embodiment is disclosed for protecting a skylight having a rectangular frame. The method includes:

- providing a pair of rails, a pair of tension members, four corner blocks, and a guard structure, each of the rails having ends that define openings, each of the four corner blocks being configured for insertion into the openings;
- providing a set of instructions on a tangible, non-transitory medium, the set of instructions including:
  - positioning a first of the pair of rails along a first side of the rectangular frame of the skylight, a first and a second of the four corner blocks being disposed in a respective one of the openings of the first of the pair of rails, so that the first and second of the corner blocks disposed in the first of the pair of rails extends beyond the first side of the rectangular frame;

positioning a second of the pair of rails along a second side of the rectangular frame of the skylight, a third and a fourth of the four corner blocks being disposed in a respective one of the openings of the second of the pair of rails, so that the third and the fourth of the corner blocks disposed in the second of the pair of rails extends beyond the second side of the rectangular frame, the second side of the frame being opposite the first side, the first of the four corner blocks and the third of the four corner blocks being opposite each other along a third side of the rectangular frame of the skylight, the second of the four corner blocks and the fourth of the four corner blocks being opposite each other along a fourth side of the rectangular frame of the skylight;

attaching a first of the pair of tension members to the first of the corner blocks and the third of the corner blocks;

attaching a second of the pair of tension members to the second of the corner blocks and the fourth of the corner blocks;

drawing the pair of rails against the first frame member and the second frame member using the pair of tension members; and coupling the guard structure to the pair of rails.

The set of instructions can further comprise inserting each of the four corner blocks into the respective one the openings of the pair of rails.

DETAILED DESCRIPTION OF THE DRAWINGS

Figure 1:
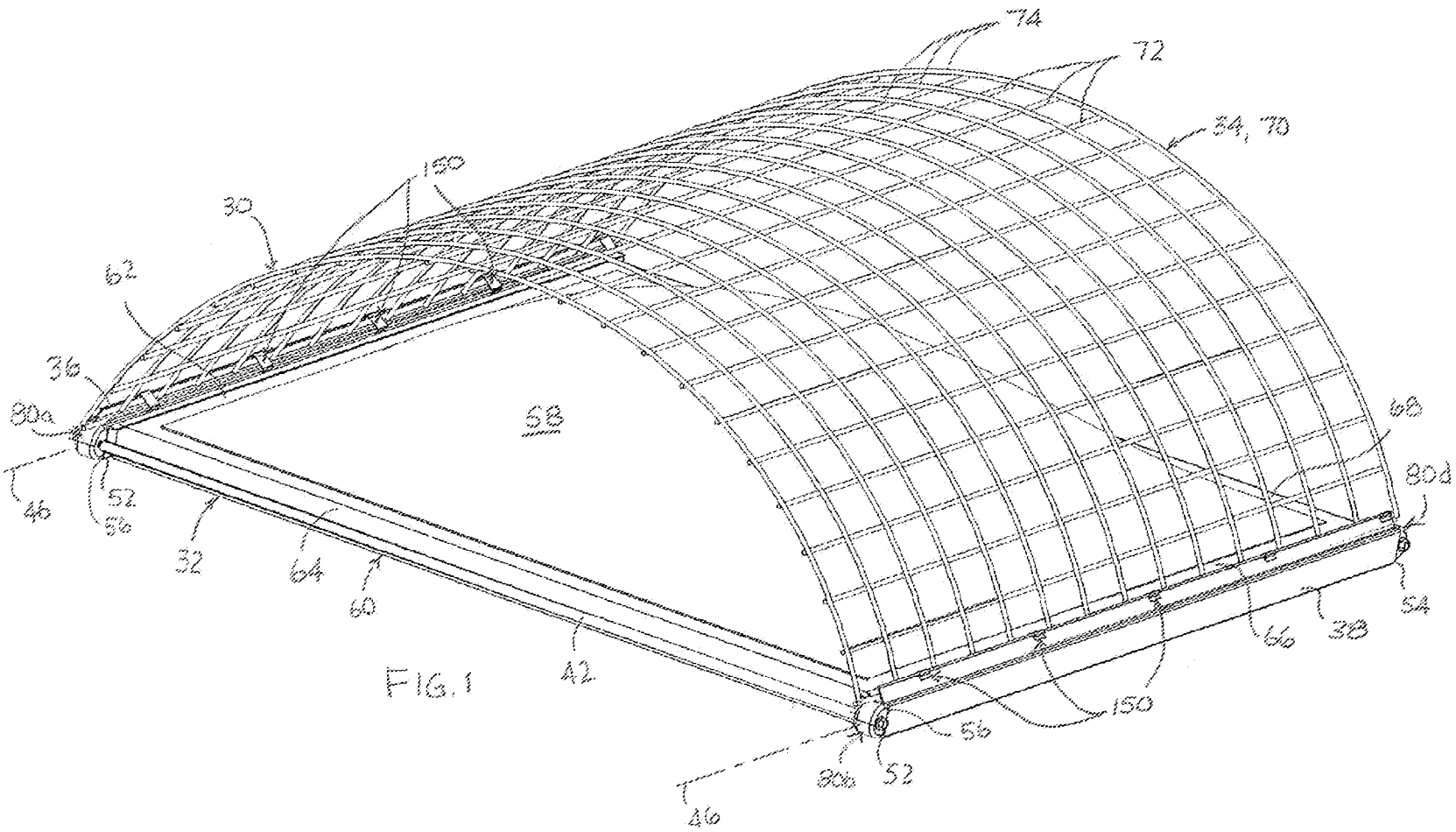
FIG. 1 is an isometric view of a guard assembly installed on a skylight in an embodiment of the disclosure.
Figure 2:
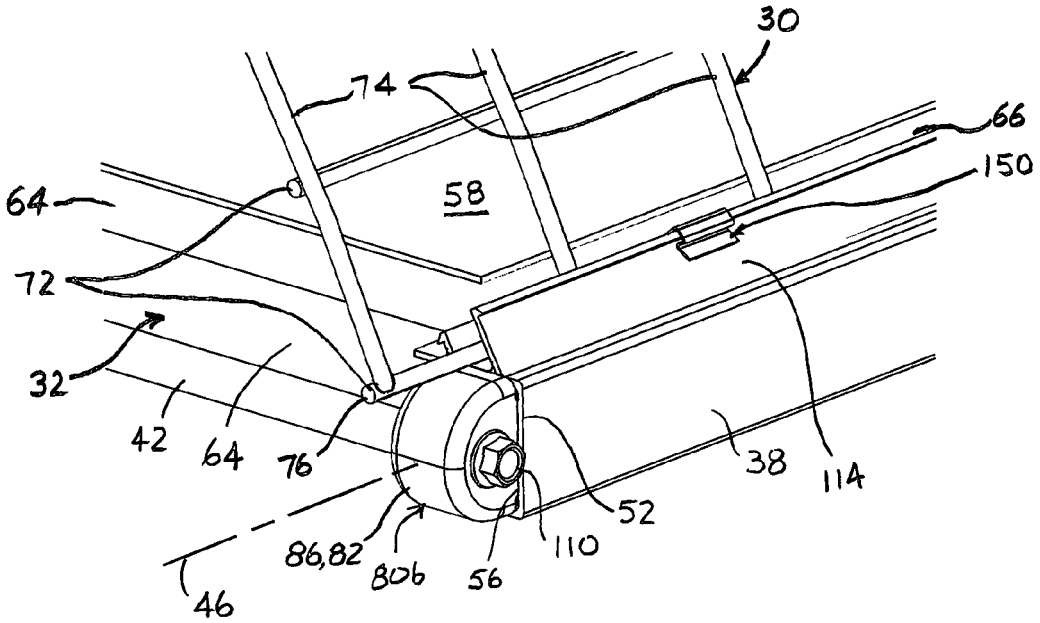
FIGS. 2 and 3 are partial enlarged views of the guard assembly and skylight of FIG. 1.
Figure 3:
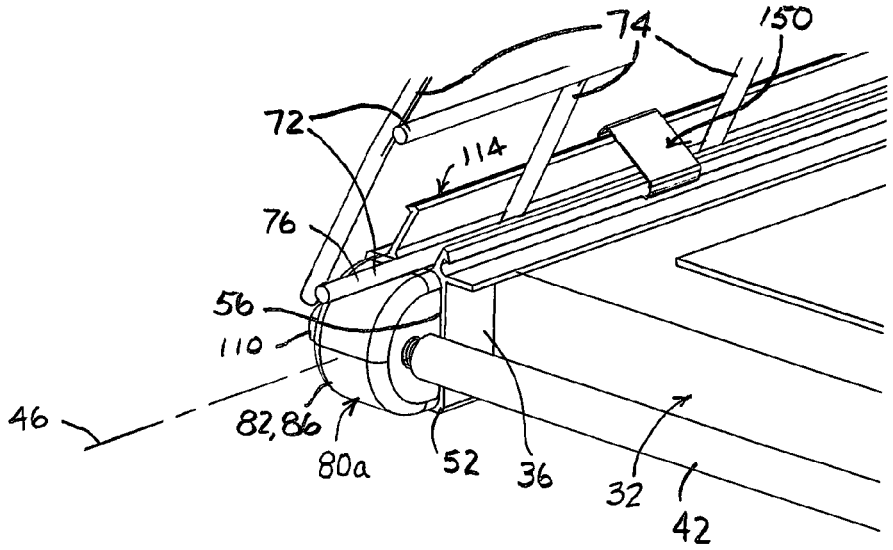
Figure 5:
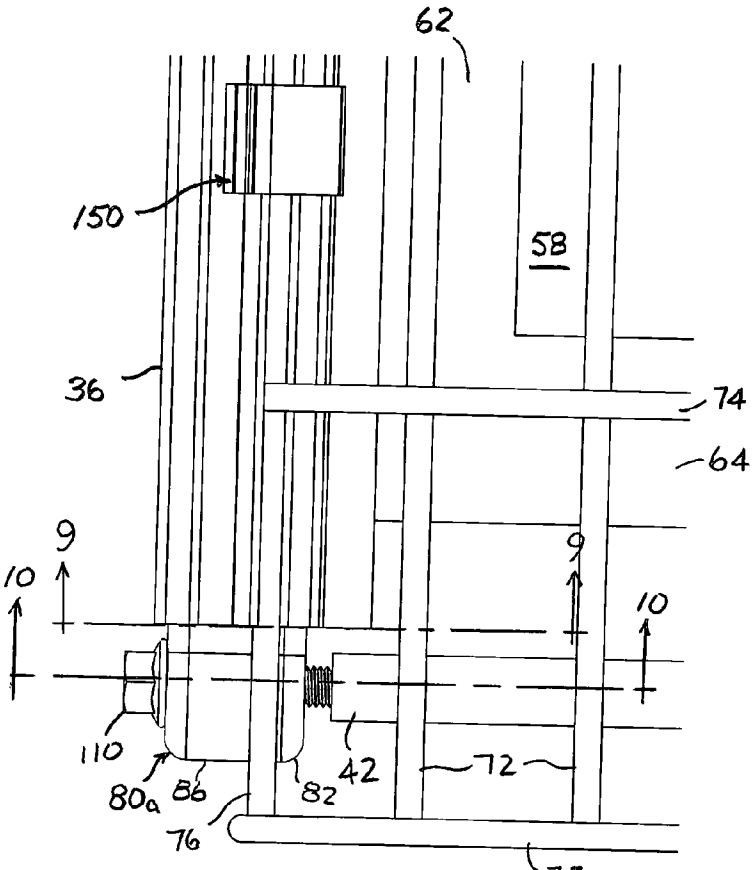
FIG. 5 is a partial, enlarged view of the guard assembly and skylight of FIG. 4.
Figure 4:
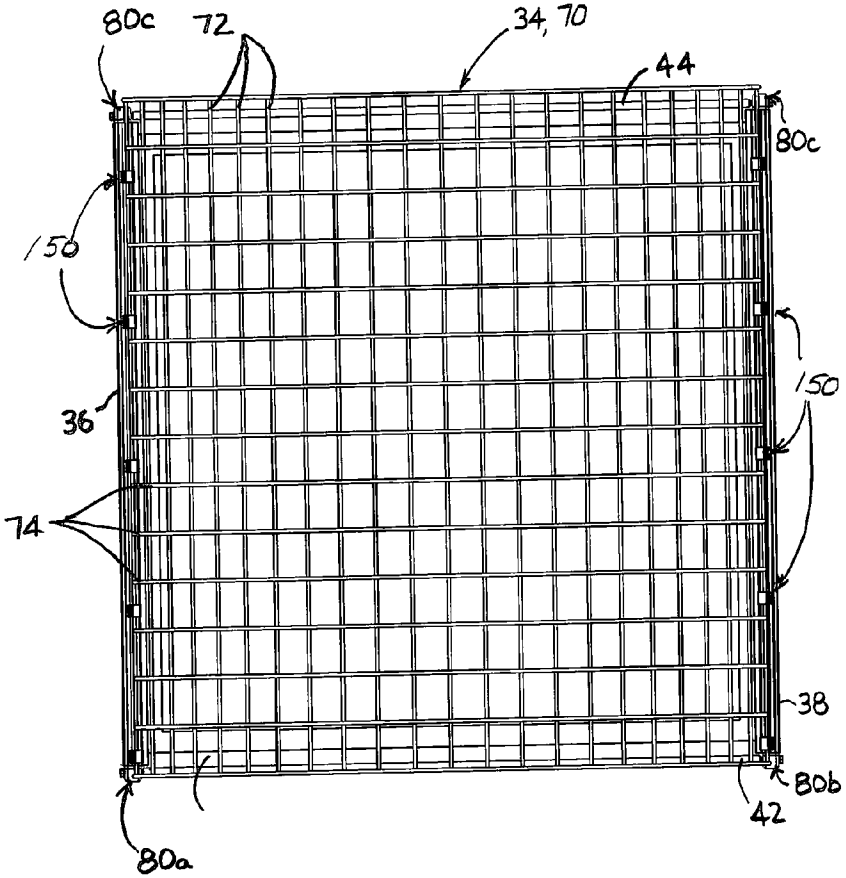
FIG. 4 is a plan view of the guard assembly and skylight of FIG. 1 in an embodiment of the disclosure.

Referring to FIGS. 1 through 5, a guard assembly 30 installed on a skylight 32 is depicted in an embodiment of the disclosure. The guard assembly 30 includes a guard structure 34 that extends over the skylight 32, a pair of rails 36 and 38, and a pair of tension members 42 and 44 connecting the rails 36 and 38. The rails 36 and 38 each define a longitudinal axis 46 and each include first and second ends 52 and 54, each end 52, 54 defining a respective opening 56. The skylight 32 includes a translucent or transparent window 58 coupled to a frame 60, the frame 60 being generally rectangular and having four frame members 62, 64, 66, and 68.

In one embodiment, the guard structure 34 comprises a mesh 70 with a plurality of longitudinal elements 72 (e.g., rods, wires, or tubes) that extend substantially parallel to the rails 36 and 38, and a plurality of lateral elements 74 that extend substantially perpendicular to the longitudinal elements 72. The longitudinal elements 72 include peripheral longitudinal elements 76 that are coupled to the rails 36 and 38. The mesh 70 can be welded together (as depicted), interwoven, or a combination thereof. The guard structure 34 can also comprise other structural forms, including but not limited to interwoven or overlaid bands, expanded metal, angled mesh, and/or perforated sheet or plate.

Figure 7:
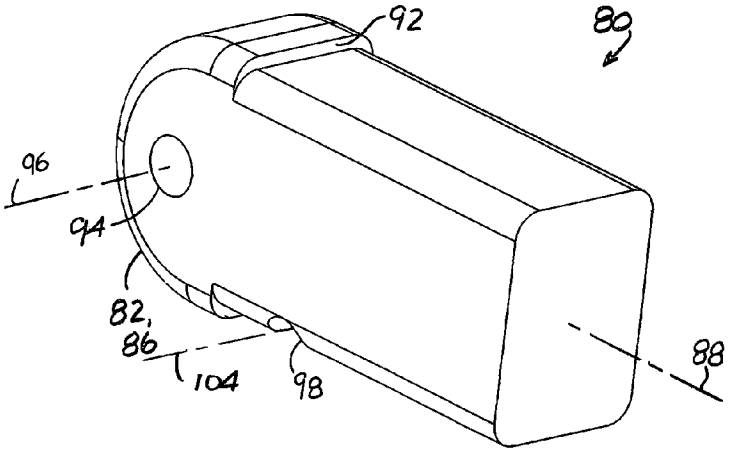
FIGS. 6 through 8 are isometric views of a corner block in an embodiment of the disclosure.
Figure 6:
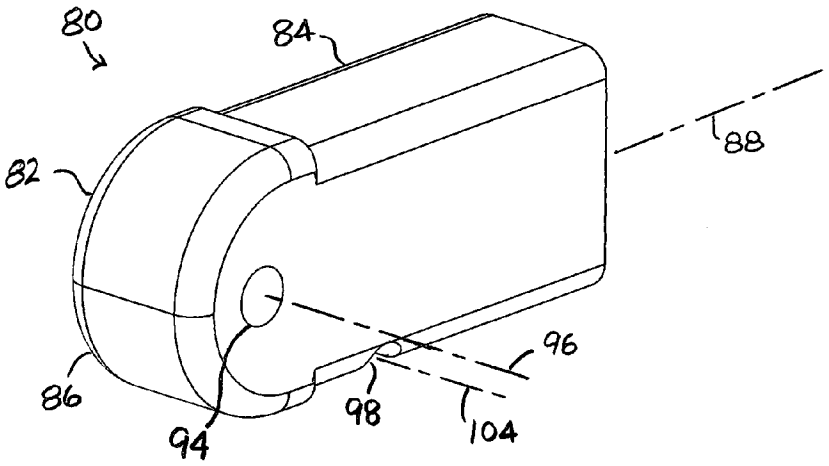
Figure 8:
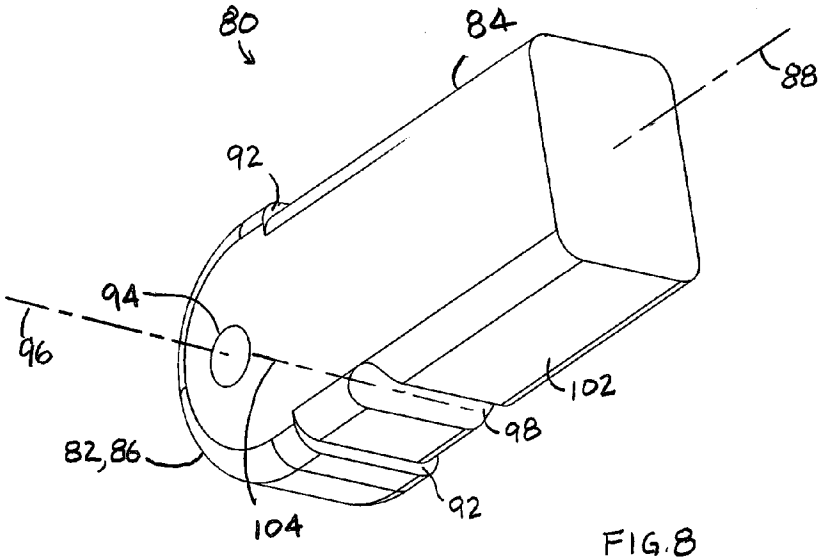

Referring to FIGS. 6 through 8, a corner block 80 is depicted in an embodiment of the disclosure. In one embodiment, a plurality of such corner blocks 80 (referred to individually as corner blocks 80*a*, 80*b*, 80*c* and 80*d* and collectively or generically as corner block(s) 80) can be disposed in the openings 56 of the rails 36 and 38 of the guard assembly 30, the corner blocks 80 extending beyond the respective frame members of the frame 60 beside which the rail 36, 38 extends (frame members 62 and 66 in the figures). In various embodiments, the corner blocks 80 each include a head portion 82 and a body portion 84. In some embodiments, the head portion 82 defines an extended portion 86 that extends out of the rail 36 or 38 to which it is mounted, along the respective longitudinal axis 46. In one embodiment, the body portion 84 is of reduced cross-sectional area perpendicular to a body axis 88, so that at least one shoulder 92 is defined at the junction of the head portion 82 and the body portion 84. The head portion 82 can further define a through hole 94 along a through axis 96, the through axis 96 being substantially orthogonal to the body axis 88. In one embodiment, a notch 98 is defined on a side 102 of the body portion 84. The notch 98 can be longitudinal along a notch axis 104 that is orthogonal to the body axis 88.

In one embodiment (not depicted), at least a portion the head portion 82 does not extend longitudinally beyond the rail 36, 38, such that the through hole 94 is disposed within the rail 36, 38. In such embodiments, apertures can be formed in the rail 36, 38 that are substantially concentric with the through axis 96, and both the head portion 82 and the apertures of the rail 36, 38 extend beyond the respective frame members along which the rail 36, 38 extends.

Figure 9:
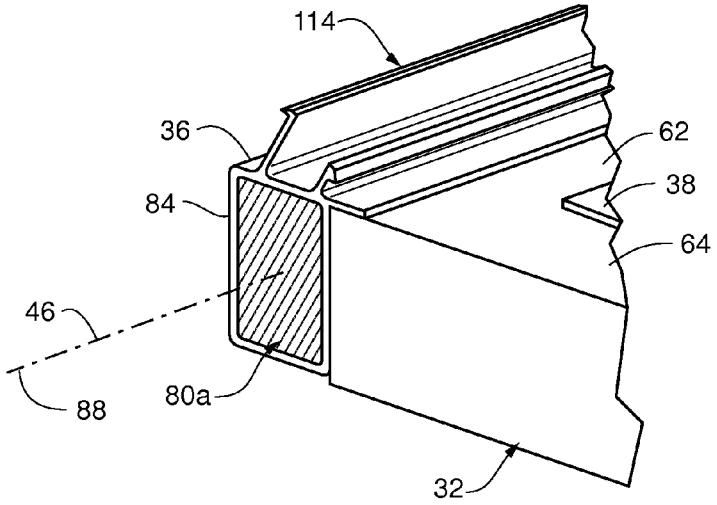
FIGS. 9 and 10 are sectional views of the guard assembly and skylight of FIG. 5.
Figure 10:
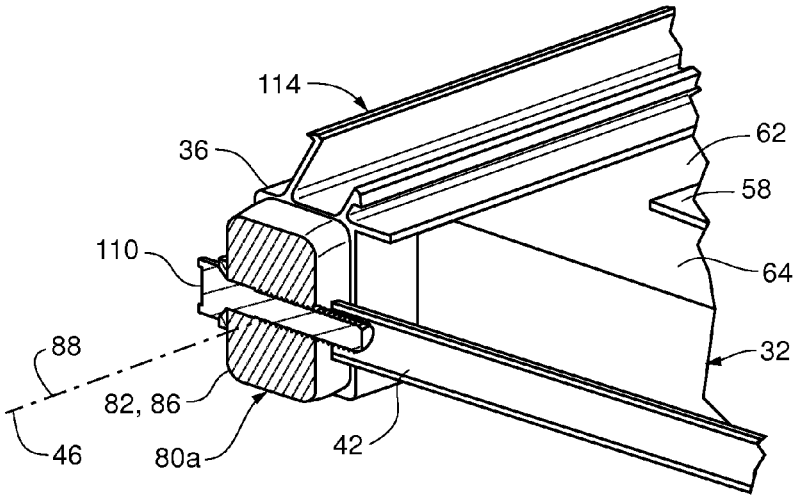

Referring to FIGS. 9 and 10, sectional views of the corner block 80*a* installed in the rail 38 is depicted in an embodiment of the disclosure. In the depicted embodiment, the longitudinal axis 46 of the rail 38 and the body axis 88 are substantially parallel and/or concentric (FIG. 9). In one embodiment, a fastener 110 is disposed in the through hole 94 and is threadably engaged with the tension member 42 (FIG. 10). The same arrangement can be configured at the other end of tension member 42 for coupling to corner block 80*b*. Tension member 44 can also be mounted to corner blocks 80*c* and 80*d* in like manner. In an alternate embodiment, the fastener can be replaced by a threaded rod (not depicted) that extends through both corner blocks 80*a* and 80*b*, the threaded rod serving as both fastener and tension member that connects corner blocks 80*a* and 80*b*; in one embodiment, the threaded rod can pass through a sleeve (not depicted) akin to tension member 42. The same alternate embodiment arrangement can be utilized to connect corner blocks 80*c* and 80*d*.

Functionally, the corner blocks 80 spread the load imparted by the tension members 42 and 44 over larger bearing surfaces than would simple aperture structures that pass through the rail 36 and 38. The larger bearing surfaces reduces the local stresses on the rail 36 and 38 per unit load imparted by the tension members 42 and 44, thereby reducing the potential of locally deforming the rail 36 and 38 due to excessive tensile stresses and creep stresses. The reduced stresses enable higher forces to be implemented by the tension members, resulting in a greater clamping force between the guard assembly 30 and the skylight 32.

The notch 98 can be utilized to help prevent the corner block 80 from sliding out of the respective opening 56 into which it is inserted. In one embodiment, a hole can be drilled and tapped and a set screw mounted therein (not depicted) so that the set screw aligns with the notch 98 when the block 80 is at the desired depth in the opening 56. In one embodiment, the rail 36, 38 can be dimpled (not depicted), for example with a punch or chisel, at a location that aligns with the notch 98. In one embodiment, holes can be formed laterally through rail 36, 38 proximate to and substantially parallel to the notch axis 104 when the block 80 is at the desired depth in the opening 56, and a pin (not depicted) placed through the holes, thereby residing in the notch 98. The screw, pin, and/or dimple structure provides an obstruction that helps prevent the corner block 80 from sliding out of the opening 56 of the rail 36, 38. The various ways to utilize the notch 98 described above are amenable to on-site fabrication techniques.

Figure 11:
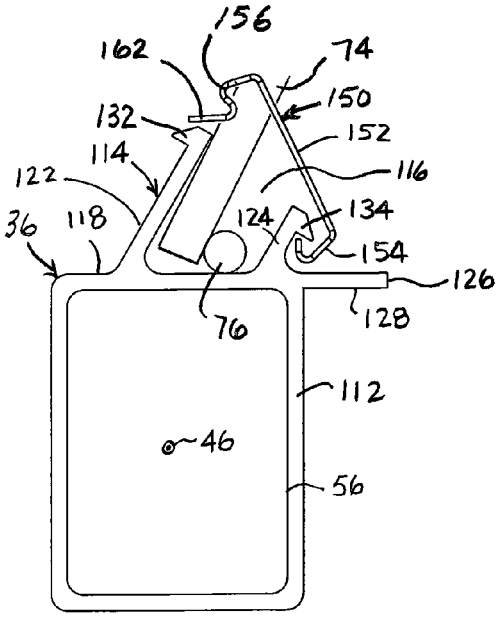
FIGS. 11 and 12 are elevation views of a rail of the guard assembly with a retention clip being installed thereon in an embodiment of the disclosure.
Figure 12:
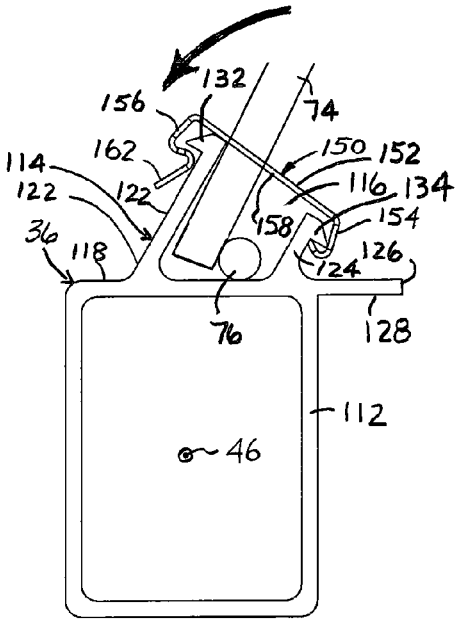
Figure 14:
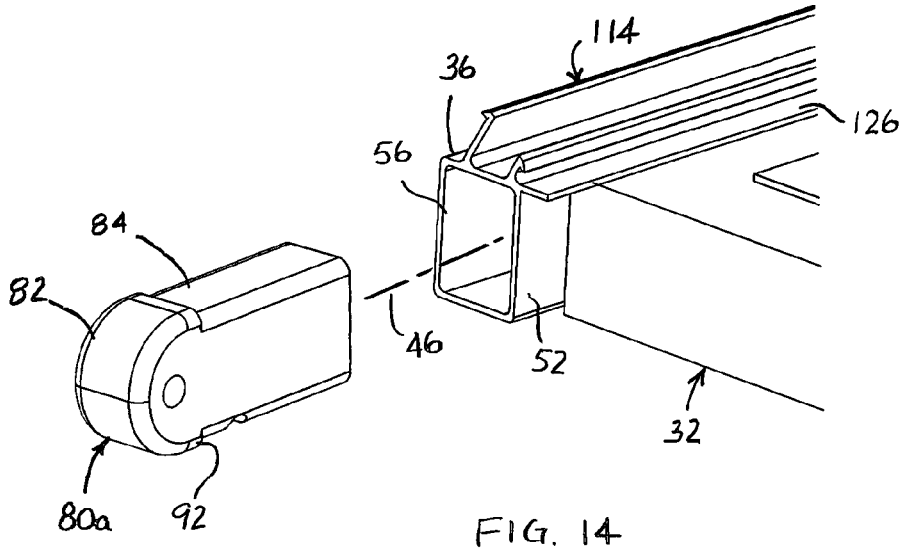
FIGS. 14 through 17 are partial isometric views of the guard assembly and skylight of FIG. 1 during installation in an embodiment of the disclosure.

Referring to FIGS. 11 and 12, an end view of the rail 36 is depicted in an embodiment of the disclosure. Each rail 36, 38 can include a tubular structure 112 with a channel structure 114 defining a channel 116 on a mounting face 118 of the tubular structure 112. In various embodiments, the channel structure 114 includes a pair of wall portions 122 and 124 that extend parallel to each other and parallel to the longitudinal axis 46. A flange member 126 can extend laterally from the tubular structure 112. In one embodiment, the flange member 126 defines a registration surface 128 that is substantially parallel to the mounting face 118. In one embodiment, the wall portions 122 and 124 can be canted towards the flange member 126. The wall portions 122 and 124 can also include claw portions 132 and 134, respectively, each claw portion 132, 134 extending outward and away from the channel 116.

Figure 13:
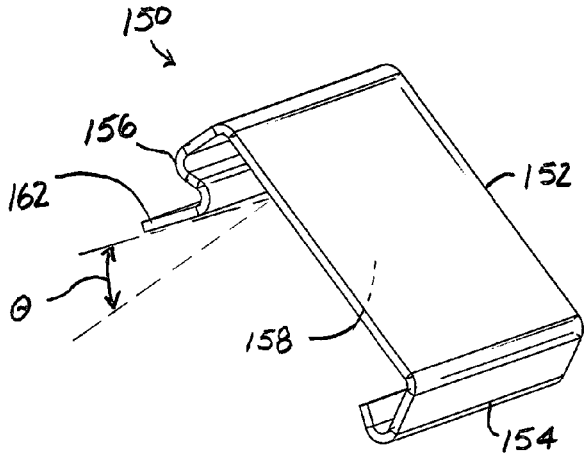
FIG. 13 is an isometric view of the retention clip of FIGS. 11 and 12 in an embodiment of the disclosure.

Referring to FIG. 13, a clip 150 for capturing the guard structure 34 within the channel 116 is depicted in an embodiment of the disclosure. The clip 150 includes a body portion 152 from which a first hook portion 154 and a second hook portion 156 depend, the hook portions 154 and 156 extending in a same direction relative to an extended face 158 of the body portion 152. In one embodiment, the second hook portion 156 includes a lead in 162 that defines an acute angle θ relative to a normal 164 of extended face 158. The hook portions 154 and 156 are spaced and dimensioned to engage with the claw portions 132 and 134 of the wall portions 122 and 124 (FIG. 12).

Referring to FIGS. 14 through 17, a method for assembling the guard assembly 30 to the skylight 32 is depicted in an embodiment of the disclosure. While the depictions present only one end of one rail (rail 36), those of ordinary skill in the art will understand how to assemble the entire structure from the example.

Figure 15:
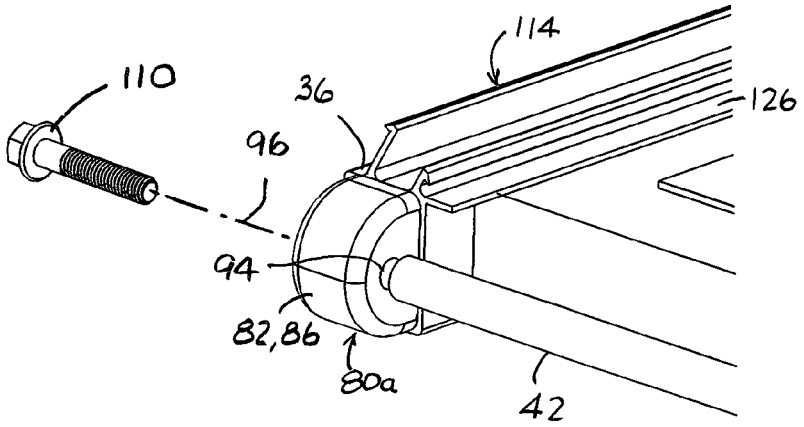

In various embodiments, the rail 36 is aligned with a first of the frame members (frame member 62) so that the flange member 126 rests on the first frame member 62. The rail 36 can be cut from common stock at the installation site to approximately the length of the first frame member 62. In one embodiment, the corner block 80*a* is disposed in the opening 56 (FIG. 14), so that the head portion 82 of the corner block 80*a* extends beyond the first frame member 62 (FIG. 15). In one embodiment, the corner block 80*a* can be inserted into the opening 56 until the shoulder(s) 92 register against the end 52. The corner block insertion procedure can be repeated at the opposing end of the rail 36 with corner block 80*c*. The same operations of cutting to length and installing corner blocks can be performed with corner blocks 80*b* and 80*d* at the ends of rail 38.

Figure 16:
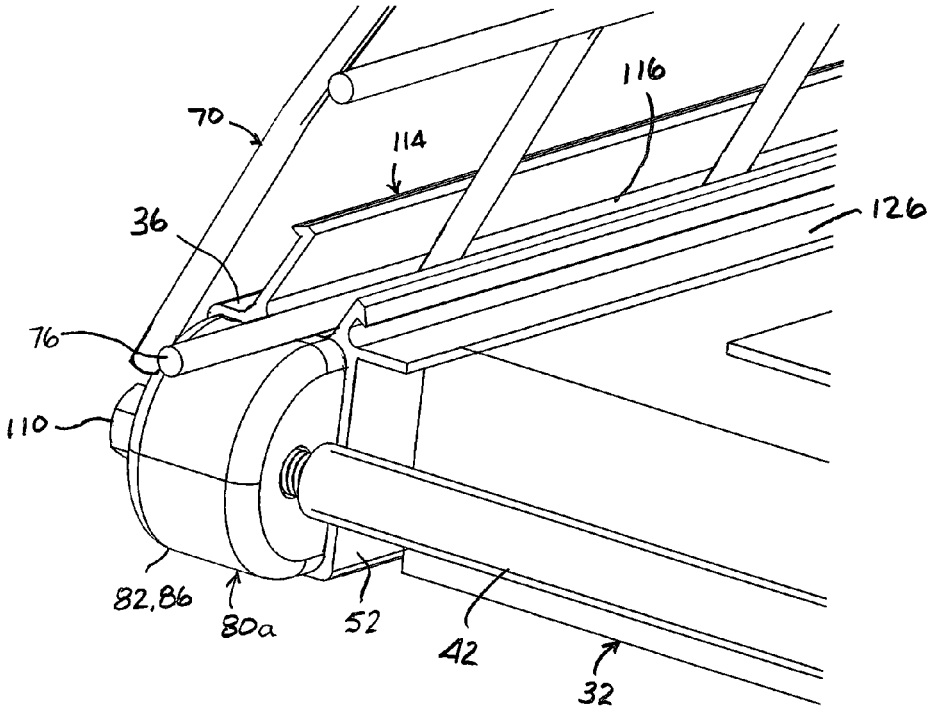

In one embodiment, the tension member 42 and fastener 110 are brought into substantial alignment along the through axis 96 on opposite sides of the through hole 94 (FIG. 15), and the fastener 110 inserted through the through hole 94 and threadably engaged with the tension member 42 (FIG. 16). The coupling of a fastener to tension member 42 through the corner block 80*b* can be repeated at the opposing end of the tension member 42. The same operations of alignment, coupling, and tightening can be performed with corner blocks 80*c* and 80*d* to the opposing ends of tension member 44. After the tension member 42 has been coupled to the corner blocks 80*a* and 80*b*, and the tension member 44 has been coupled to the corner blocks 80*c* and 80*d*, the fasteners 110 can be tightened to draw the rails 36 and 38 into a clamping contact the frame 60 of the skylight 32.

In one embodiment, the tension members 42 and 44 can be cut to a length that is shorter than the frame members 64 and 66 along which the tension members 42 and 44 are adjacent, the length of the tension members 42 and 44 being long enough to readily engage the fastener when passed through the respective corner block 80, and short enough so that the tension members 42 and 44 do not engage both corner blocks 80 that are coupled via the fasteners 110. In one embodiment, the tension members can include internal threads formed along the entire or substantial length, to facilitate threadable engagement with the fasteners 110 regardless of the cut length of the tension members; in other embodiments, the tension members can comprise tubular structures with smooth interior walls, with threads being formed at the ends of the tension members 42 and 44 with a hand tap after the tension members 42 and 44 are cut to length. In still other embodiments, the tension members 42 and 44 and fasteners 110 are replaced by threaded rods (not depicted) that are passed through the corner blocks 80*a*, 80*b* and 80*c*, 80*d* and coupled thereto with nuts.

The guard structure 34 is operatively coupled to the rail 36. The guard structure 34 is of sufficient width so that it bows above the skylight 32 when opposing sides are coupled to the rails 36 and 38. For embodiments where the rail 36 includes the channel structure 114, an edge of the guard structure 34 is inserted into the channel 116 of the rail 36. In one embodiment, the guard structure is then bowed so that an opposing edge of the guard structure 34 can be inserted into the channel of rail 38.

For embodiments where the guard structure 30 is the mesh 70 and/or having peripheral longitudinal elements 76, one of the peripheral longitudinal elements 76 is inserted into the channel 116 of the rail 36 (FIG. 16), and the other of the peripheral longitudinal elements 76 is inserted into the channel of rail 38. The mesh 70 can possess a certain degree of resiliency so that the lateral elements 74 exert a substantial biasing force against the wall portion 122, as depicted at FIGS. 11 and 12. For some embodiments, the biasing force is adequate to secure the mesh 70 (or other structural forms for the guard structure 30) to the rails 36 and 38.

Figure 17:
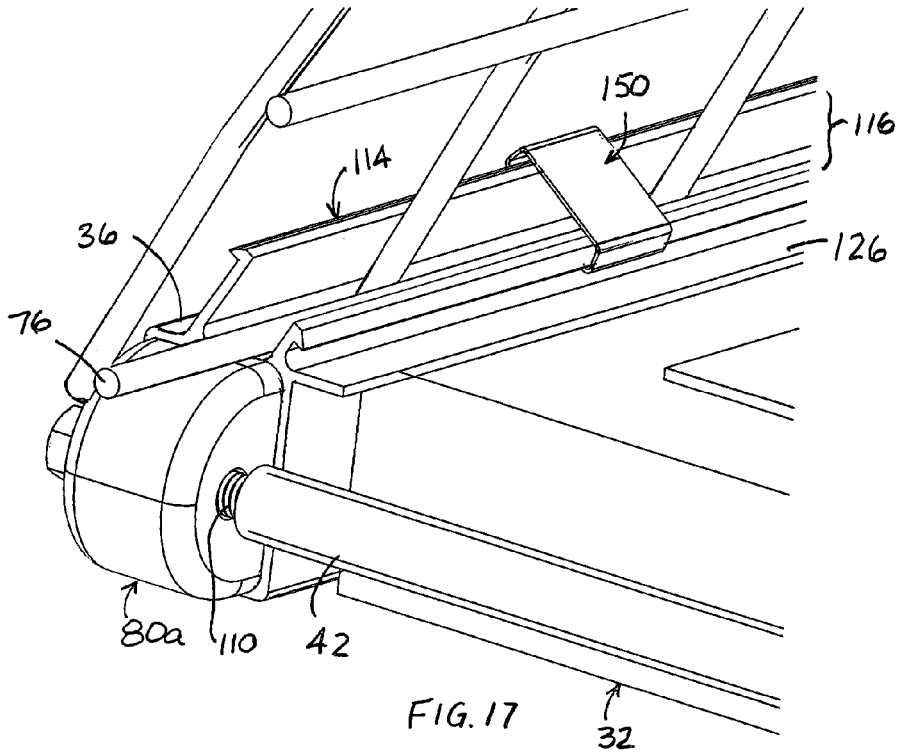

In some embodiments, the clips 150 are coupled to the claw portions 132 and 134 of the wall portions 122 and 124, thereby capturing the peripheral longitudinal element 76 within the channel 116 (FIG. 17). Installation of the clips are depicted at FIGS. 11 and 12. The first hook portion 154 is brought into contact with one of the claw portions (e.g., claw portion 132 in FIG. 11) and rotated over the channel 116 until the lead in 162 of the second hook portion 156 is brought into contact with the other of the claw portions (claw portion 134 in FIG. 12). The second hook portion 156 is then pushed onto the other of the claw portions so that the lead in slides over the other of the claw portions until the second hook portion 156 snaps into place (FIG. 12).

In one embodiment, the clips 150 can be readily removed by pulling the lead in 162 away from the claw portion to which the second hook portion 156 is coupled (claw portion 134 in FIG. 12), for example by prying upwards with the fingers of one's hand or by gripping with a pliers. The ready removal of the clips 150 facilitates removal of the guard structure 34 for servicing the resident skylight 32.

Functionally, the clips 150 capture the peripheral longitudinal elements 76 within the channel 116, thereby helping prevent the mesh 70 from being lifted out of the channel 116. The clips 150, being disposed between lateral elements 74 that are adjacent each other, can also resist movement of the mesh 70 along the length of the channel 116 (i.e., parallel to the longitudinal axis 46).

In some embodiments, rather than utilizing the clips 150 which are removable, the guard structure 34/mesh 70 can be permanently affixed to the rails 36 and 38, for example by welding or by a permanent crimped-on clip (not depicted). Permanently affixing the guard structure 34 to the rails 36, 38 can facilitate tamper resistance to deter burglary and vandalism.

It is noted that the assembly of the guard assembly 30 is not limited to the order of the steps as presented herein. For example, it may be advantageous to mount the guard structure 34 to the rails 36 and 38 prior to coupling the rails 36 and 38 to the skylight 32, instead of after as depicted and described herein. Other steps of the assembly method recited herein can be performed out of the disclosed sequence, as will be readily apparent to the artisan having ordinary skill in the art.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant art will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A skylight assembly, comprising:

a skylight having a substantially rectangular frame; and a skylight guard assembly operatively coupled with said rectangular frame of said skylight, said skylight guard assembly including:

a pair of rails disposed on opposing sides of said rectangular frame of said skylight, each rail of said pair of rails including a first end and a second end, each of said first end and said second end defining a respective opening;

a guard structure operatively coupled with said pair of rails and extending over said skylight;

a plurality of corner blocks, each corner block of said plurality of corner blocks disposed in a corresponding one of said respective openings of said first end and said second of said pair of rails; and a pair of tension members, each tension member of said pair of tension members extending substantially between and orthogonal to said pair of rails and being operatively coupled to a respective pair of said plurality of corner blocks.

2. The skylight assembly of claim 1, wherein each of said plurality of corner blocks includes an extended portion that extends outward from said corresponding one of said respective openings.

3. The skylight assembly of claim 2, wherein said pair of tension members are coupled to the extended portions of said plurality of corner blocks.

4. The skylight assembly of claim 1, wherein said each of said pair of rails are hollow tubular members.

5. The skylight assembly of claim 1, wherein each of said pair of rails includes a laterally extending flange that extends over said rectangular frame of said skylight.

6. The skylight assembly of claim 1, wherein each of said pair of rails defines a channel that extends parallel to said rectangular frame of said skylight, said guard structure being disposed in said channel.

7. The skylight assembly of claim 1, wherein said guard structure comprises a mesh.

8. The skylight assembly of claim 1, wherein said pair of tension members are coupled to said plurality of corner blocks with threaded fasteners that pass through said plurality of corner blocks.

* * * * *